US005560269A

United States Patent [19]

Zelenka

[11] Patent Number: 5,560,269

[45] Date of Patent: Oct. 1, 1996

[54] WRENCH FOR USE WITH SEIZED ENGINE OIL FILTER AND METHOD

[76] Inventor: Jerry L. Zelenka, 8115 W. Wing Mountain Rd., Flagstaff, Ariz. 86001

[21] Appl. No.: 450,924

[22] Filed: May 26, 1995

[51] Int. Cl.[6] ..... B67B 7/14

[52] U.S. Cl. ..... 81/3.4; 81/125

[58] Field of Search ..... 81/53.2, 3.4, 3.49, 81/125

[56] References Cited

U.S. PATENT DOCUMENTS

| | | | |
|---|---|---|---|
| 3,094,022 | 6/1963 | Young | 81/53.2 |
| 3,853,026 | 12/1974 | Rhodes | 81/53.2 X |
| 4,607,547 | 8/1986 | Martus | 81/53.2 |
| 5,123,310 | 6/1992 | McManus | 81/125 |

*Primary Examiner*—James G. Smith
*Attorney, Agent, or Firm*—John S. Christopher

[57] ABSTRACT

A wrench for use with a seized engine oil filter typically employed in a mechanical environment in which a conventional threaded oil filter cannot be removed from an oil lubricated engine. The oil filter wrench comprises a cap-shaped housing including a planar top surface and a wall formed orthogonal to the perimeter of the top surface. A plurality of flat keyed edges formed on an interior surface of the wall are provided for engaging a housing of the oil filter. Several threaded shaft and nut assemblies are mounted to the wall for piercing said oil filter housing. The threaded shaft and nut assemblies lock the cap-shaped housing to the oil filter for maximizing the torque on the oil filter when the cap-shaped housing is rotated. A socket receptacle formed in the planar top surface enables rotation of the cap-shaped housing. In a preferred embodiment, the flat keyed edges formed on the interior surface of the wall enable the cap-shaped housing to be fitted over the edges of a conventional oil filter. The threaded shafts are then advanced so as to pierce and lock the oil filter housing to the cap-shaped housing. The cap-shaped housing is then forcibly rotated by a tool fitted into the socket receptacle. In an alternative embodiment, the threaded shaft and nut assemblies are secured to a metallic band pivotally attached to a handle. After the band has been tightened about the oil filter housing, the threaded shafts are advanced so as to pierce and lock the oil filter housing to the band. The handle is then rotated to maximize torque on the seized oil filter.

8 Claims, 3 Drawing Sheets

FIG. 4
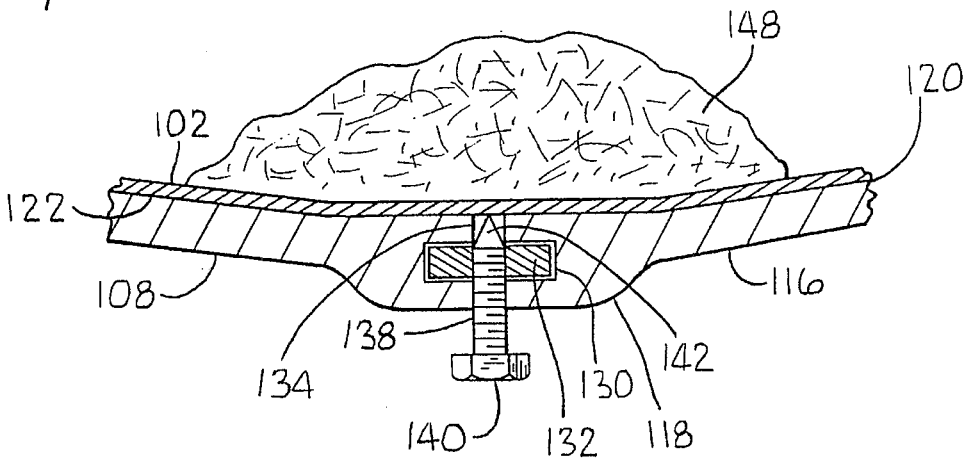
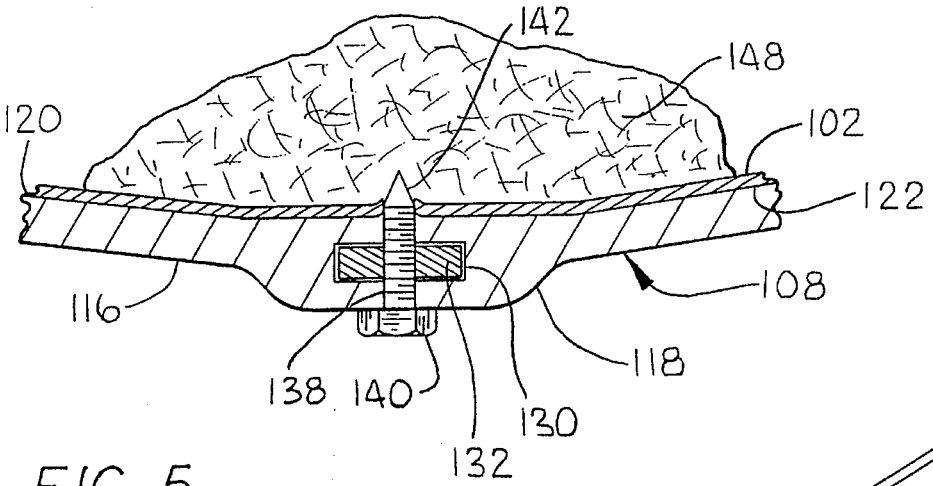
FIG. 5
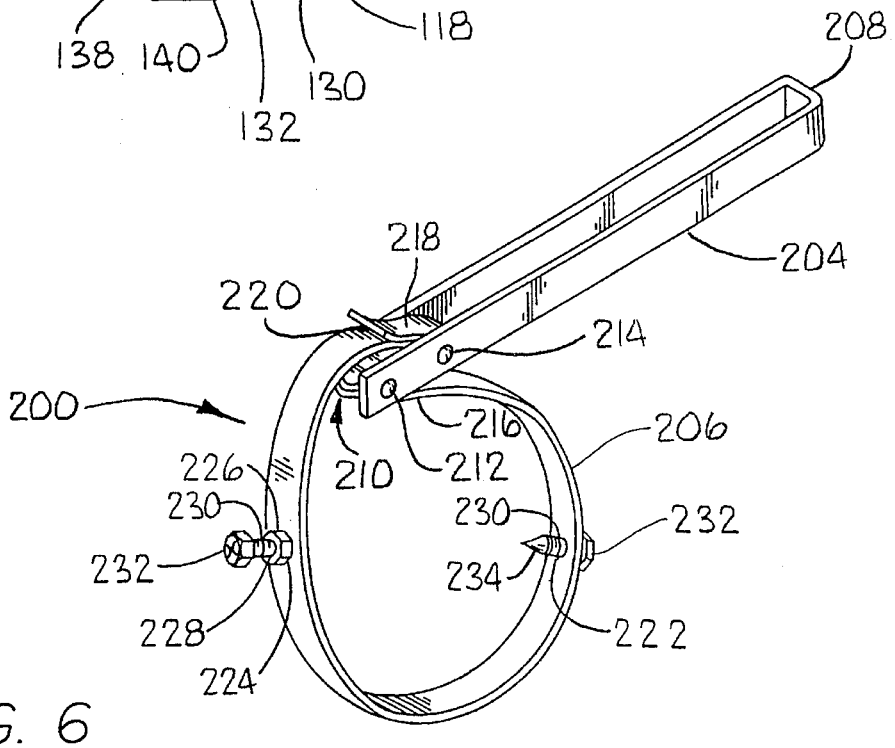
FIG. 6

WRENCH FOR USE WITH SEIZED ENGINE OIL FILTER AND METHOD

BACKGROUND OF THE INVENTION

1. Field of the Invention

The present invention relates to an oil filter wrench. More specifically, the present invention relates to methods and apparatus for a wrench used with a seized conventional engine oil filter that incorporates a plurality of threaded shaft and nut assemblies employed to lock the wrench to the seized oil filter for maximizing the torque applied to the seized oil filter when the wrench is rotated.

2. Description of the Related Art

Modern engines utilized in automobiles, emergency power generating stations and the like employ a conventional oil filter element for filtering the oil. The oil filter element is contained within a housing. The oil filter housing typically includes an arrangement of intake and output ports for receiving and exhausting a supply of lubricating oil to be filtered. Further, the oil filter is typically secured to the side of the engine block by metallic threads, e.g., the oil filter is threaded onto the engine block.

The oil filter housing is comprised of a thin metallic enclosure having a closed end and an open end. The enclosure includes a plurality of (e.g., typically 14–16) edges or lugs at the closed end designed for grasping and rotating the filter housing. The open end of the filter housing includes an arrangement of intake and output ports and a thread engagement arrangement each known in the art. The threads on the filter housing and the threads on the oil filter mount on the engine are engaged and the filter is secured in position by rotation of the filter. Removal of the filter is accomplished by rotation of the filter housing in the opposite direction. Thus, this type of conventional engine oil filter is referred to as a "spin-on" filter.

A set of manufacturer's instructions normally are supplied with the purchase of a new conventional spin-on oil filter. The instructions typically recite a procedure for installing and removing the oil filter. Attached to the open end of the oil filter is an oil seal designed to prevent leakage of oil from the filter during use. The instructions for the installation of the spin-on oil filter typically direct the installer to rotate the filter housing an additional ¾-to-1 turn after the oil seal initially touches the base of the oil filter mount on the engine. The filter installation is usually accomplished by use of a conventional oil filter installation tool known in the art.

Occasionally, an installer decides that the additional ¾-to-1 turn of the filter housing (after the oil seal initially touches the base of the oil filter mount) suggested by the manufacturer during installation is insufficient to avoid oil leakage or loss of the filter element. Thus, a typical installer of average strength can easily over-tighten the filter housing using only nominal torque with the conventional installation tool. This snug or over-tightening of the filter housing beyond the recommended number of turns often leads to the condition of a seized or over-torqued oil filter when oil filter element replacement is attempted.

Several factors contribute to the seized or over-torqued filter condition. Some of these factors are directly related to the characteristics of a new filter versus a used filter. For example, less torque is required to install a new oil filter housing because the components, such as the oil seal, have not yet been expanded. The expansion of the oil seal in a used oil filter typically results in more torque being required to remove the filter housing. A major factor contributing to the seizure of filter elements is the engine heat to which the filter housing is subjected. The components of the oil filter are subjected to thermal expansion due to the heat from the engine. The thermal expansion in combination with oil saturation of the filter components over time results in more torque being required to remove the filter housing. Further, failure to lubricate the oil seal during installation often results in seizure of the filter element due to the thermal expansion of the filter components.

In the past when an oil filter housing was over-torqued and seized to the oil filter mount on the engine, removal of the filter element was very difficult and time consuming. The only available means of removing the seized filter housing was to attempt to manipulate the filter housing with screwdrivers, chisels, hammers and the like. Often these tools are insufficient to remove the seized filter housing because of space limitations and thus adequate leverage could not be achieved. The seized oil filter was often mutilated and removal became impossible.

Over time, many types of oil filter wrenches have been developed to install and remove oil filters. These conventional oil filter wrenches include, for example, a cup type wrench, a band type wrench, a chain type wrench, a strap type wrench and a clamp type wrench. The cup type wrench typically fits over the end of the filter by mating the keyed edges of the wrench with the 14–16 edges or lugs formed on the closed end of the filter housing. The cup type wrench is then rotated to install and remove the oil filter.

However, experience has shown that the cup type wrench has severe limitations. The keyed edges of the cup type wrench are formed of steel or cast aluminum construction. When the keyed edges of the cup type wrench are mated with the softer thinwalled construction of the oil filter housing, the amount of rotational torque that can be applied is limited. The limit on the permissible rotational torque can easily be exceeded when the filter housing is being removed. The edges or lugs formed on the filter housing can be rounded off when the cup type wrench slips off of the filter housing. This condition further reduces any chance of the removing a seized oil filter from the engine block. This left the mechanic with no other alternative than to attempt to remove the filter housing with screwdrivers, chisels, hammers and the like.

Each of the conventional band type, chain type and strap type wrenches include a band, chain or strap, respectively, that is wrapped around the circumference of the oil filter housing. In the conventional band type wrench, the band is typically comprised of flexible steel having a smooth surface. Therefore, the gripping surface of the band is smooth. Consequently, the flexible band will slip around the circumference of the filter housing upon attempting to remove an oil filter that is seized in position. The chain type wrench is similar in construction to the band type wrench except a chain is utilized in lieu of the flexible steel band. The chain type wrench might provide some additional clamping force on the filter housing when compared to the smooth gripping surface of the flexible steel band. However, the chain type wrench is not effective in removing a seized oil filter that was over-torqued when initially installed.

The strap type wrench utilized to install and remove oil filters typically includes a web band comprised of flexible material. A material normally utilized for this application is nylon which is, of course, a strong synthetic material. However, the nylon material suffers from the same drawbacks as does the flexible steel band in that the nylon strap has an essentially smooth surface. Consequently, when the nylon strap type wrench is used to remove an oil filter, it is usually ineffective if the filter housing is seized. As more torque is applied to the filter housing via the wrench handle, the rotational torque limit is eventually exceeded and the nylon strap slips around the circumference of the filter housing. The clamp type wrench includes a construction that attempts to clamp around either the bottom or side of the filter housing. Because the surface of the oil filter housing is smooth, the clamp type wrench tends to slip when rotated. This, of course, is not effective when attempting to remove an oil filter when the filter housing is seized.

Another problem associated with utilizing conventional oil filter wrenches is space limitation caused by obstructions, particularly when dealing with automotive applications. Automobile components such as the exhaust manifold, exhaust pipes, oil pan, body, frame and other components tend to limit the available space to operate the conventional style wrench. Each of the conventional oil filter wrenches includes a handle which is either attached to or closely connected to the wrench. Therefore, the side components of the engine and automobile tend to obstruct the operation of the handle of conventional wrenches from the side. The side obstructions in combination with the slippage of the conventional oil filter wrench about the oil filter housing results in the inability to remove a seized oil filter.

Thus, there is a need in the art for an improvement in wrenches that are utilized with engine oil filters and particularly with engine oil filters that are seized, over-torqued or otherwise cannot be removed from an oil lubricated engine where the improved oil filter wrench would achieve a positive lock on the seized oil filter for maximizing the torque applied to the seized oil filter when the oil wrench is rotated.

SUMMARY OF THE INVENTION

The need in the art is addressed by the wrench for use with a seized engine oil filter of the present invention. The invention is typically employed in a mechanical environment such as an automotive center or an emergency power generating station in which a conventional threaded oil filter is seized, over-torqued or otherwise cannot be removed from an oil lubricated engine. The oil filter wrench comprises a cap-shaped housing including a planar top surface and a wall formed orthogonal to the perimeter of the top surface. A plurality of flat keyed edges formed on an interior surface of the wall are provided for engaging a housing of the oil filter. Several threaded shaft and nut assemblies are mounted to the wall for piercing said oil filter housing. The threaded shaft and nut assemblies lock the cap-shaped housing to the oil filter for maximizing the torque on the oil filter when the cap-shaped housing is rotated. A socket receptacle formed in the planar top surface enables rotation of the cap-shaped housing.

In a preferred embodiment, the flat keyed edges formed on the interior surface of the wall enable the cap-shaped housing to be fitted over the edges formed on one end of a conventional oil filter. The threaded shafts are then advanced so as to pierce and lock the oil filter housing to the cap-shaped housing at several locations. The cap-shaped housing is then forcibly rotated by a tool fitted into the socket receptacle. In an alternative embodiment, the threaded shaft and nut assemblies are secured to a metallic band pivotally attached to a handle. After the band has been tightened about the oil filter housing, the threaded shafts are advanced so as to pierce and lock the oil filter housing to the band. The handle is then rotated to maximize torque on the seized oil filter.

BRIEF DESCRIPTION OF THE DRAWINGS

FIG. 4 is a partial cross-sectional view of the threaded shaft and nut assembly of the wrench taken along the line 4—4 of FIG. 1 showing the threaded piercing shaft in the withdrawn position.

FIG. 5 is a partial cross-sectional view of the threaded shaft and nut assembly of the wrench taken along the line 4—4 of FIG. 1 showing the threaded piercing shaft penetrating the housing of a conventional oil filter.

FIG. 6 is a perspective view of an alternative embodiment of a wrench for use with a seized engine oil filter showing a modified threaded shaft and nut assembly.

DESCRIPTION OF THE INVENTION

Figure 1:
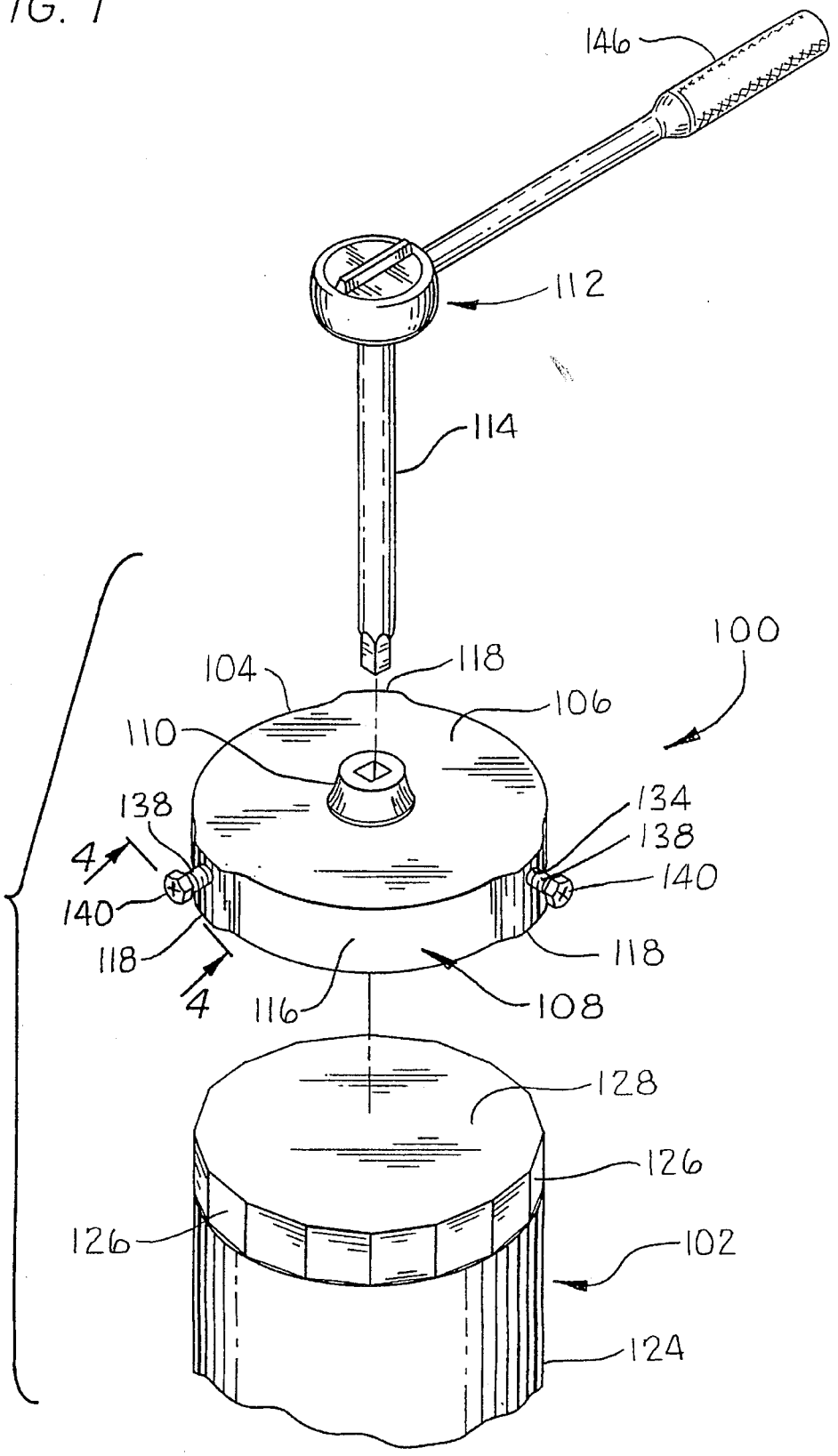
FIG. 1 is an exploded view of the wrench for use with a seized engine oil filter of the present invention showing the alignment of the wrench with respect to a conventional oil filter and a plurality of threaded piercing shafts for locking the wrench to the oil filter.

The present invention is a wrench 100 for use with a seized engine oil filter 102 as shown in FIG. 1. The oil filter wrench 100 is typically employed in a mechanical environment such as an automotive center or an emergency power generating station wherein a conventional threaded oil filter is seized, over-torqued or otherwise cannot be removed from an oil lubricated engine. The oil filter wrench 100 shown in FIG. 1 includes a cap-shaped housing 104 having a top surface 106 that is planar and generally circular in shape. The cap-shaped housing 104 also includes a wall 108 that is orthogonal to the perimeter of the planar top surface 106.

Formed on the top of the planar top surface 106 is a socket receptacle 110 that enables forcible rotation of the cap-shaped housing 104 by a tool 112. The tool 112 can be any of several tools known in the mechanical arts such as a ratchet driver including an extension shaft 114 as shown in FIG. 1. The socket receptacle 110 is shown as being square in shape but can be adapted to whatever geometric design is necessary to accommodate the tool 112 and extension shaft 114. The socket receptacle 110 can be sized to accommodate a standard ⅜" drive extension shaft 114. The bottom of the socket receptacle 110 can be either flush with or just slightly below the planar top surface 106.

The wall 108 of the cap-shaped housing 104 is molded to the planar top surface 106 and has a generally smooth circular exterior surface 116 except for three identical exterior extending protuberances 118 as shown in FIG. 1. The interior surface 120 of the wall 108 is clearly shown in FIG. 2. The interior surface 120 is formed to include typically fourteen-to-sixteen flat keyed edges 122. In the illustration of the preferred embodiment in FIG. 2, fifteen of the flat keyed edges 122 are shown, e.g., one every 24 degrees. The engine oil filter 102 includes a housing 124 having a plurality of edges or lugs 126 formed on the exterior surface of a closed end 128 as shown in FIG. 1.

The function of the flat keyed edges 122 of the interior surface 120 of the wall 108 is to mate with the corresponding edges or lugs 126 formed on the oil filter housing 124. When mated, the wrench 100 fits snugly over the closed end 128 of the oil filter housing 124. Each of the three exterior extending protuberances 118 are cast into the wall 108 in a symmetrical manner, e.g., at integrals of 120 degrees as is shown in FIG. 1 and more particularly in FIG. 2. Thus, there is one protuberance 118 for every five flat keyed edges 122. Each of the protuberances 118 is a bump or raised portion formed on the exterior surface 116 of the wall 108.

Figure 2:
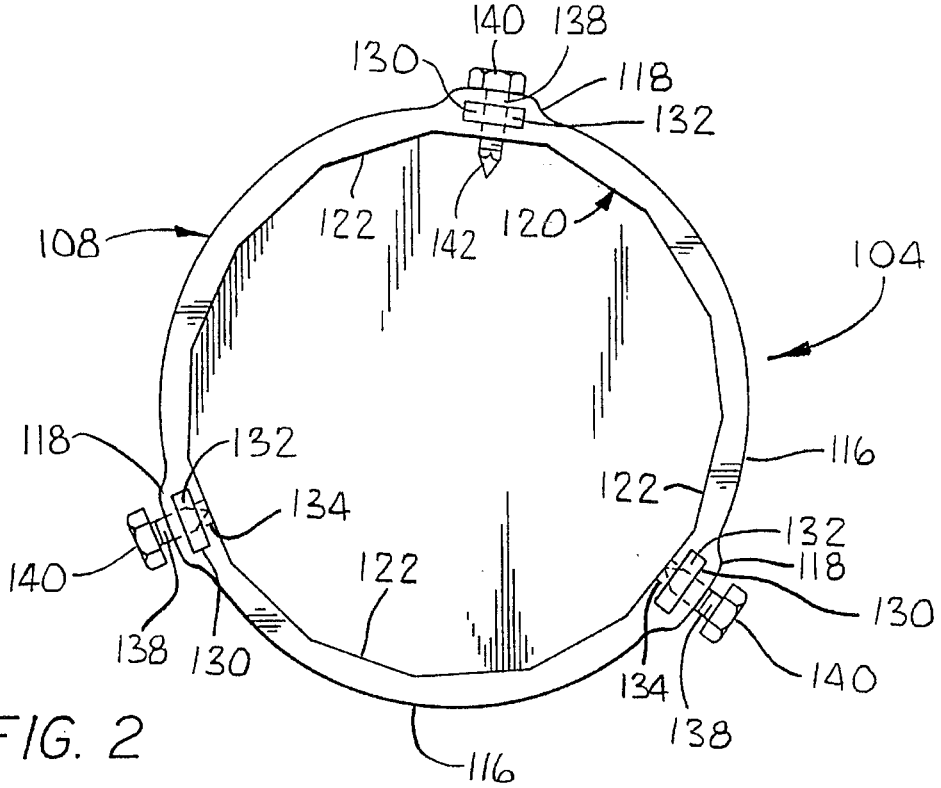
FIG. 2 is a bottom planar view of the wrench of FIG. 1 showing a plurality of threaded shaft and nut assemblies and an arrangement of flat keyed edges to fit the corresponding edges of the conventional oil filter.
Figure 3:
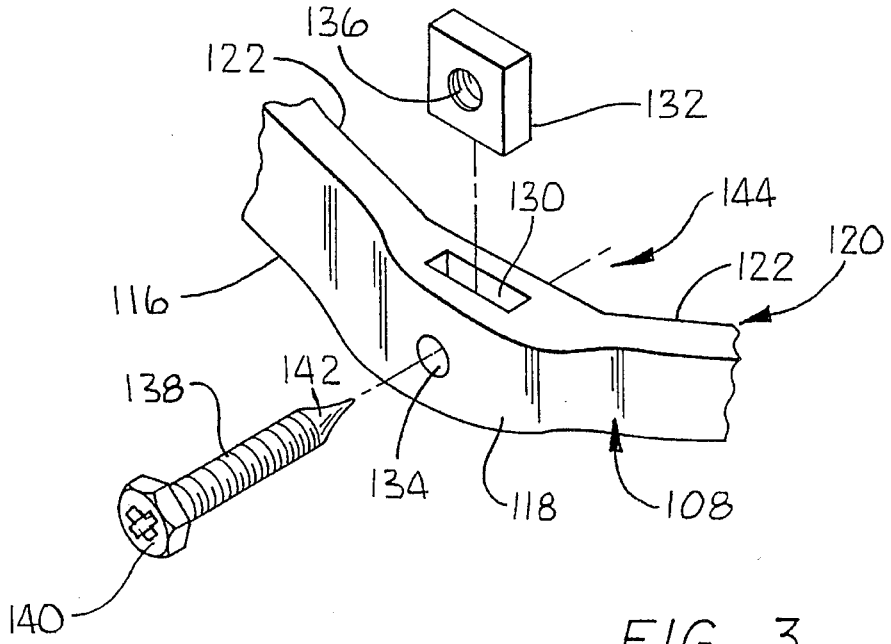
FIG. 3 is a detailed view of a threaded shaft and nut assembly of the wrench of FIG. 1 showing a protuberance in which a slot is formed to house the nut and a penetration through which the threaded shaft passes.

Formed within each of the protuberances 118 within the wall 108 during the casting process is a slot 130 shown in FIGS. 2–5. The slot 130 is generally rectangular in shape and is only accessible from the bottom of the wall 108 as shown in FIGS. 2–3. Thus, the slot 130 does not penetrate the planar top surface 106 of the cap-shaped housing 104. The slot 130 serves to accommodate a square-shaped threaded nut 132 comprised of steel and shown in FIGS. 3–5. A threaded steel nut having the dimensions ⅛" thick ×⅜" width is suitable. Thus, the slot 130 must have slightly larger dimensions.

A guidehole 134 is formed entirely through each protuberance 118 and corresponding flat keyed edge 122 on the interior surface 120 of the wall 108. The guidehole 134 is positioned so as to be in alignment with a threaded hole 136 formed through the center of the nut 132 shown best in FIG. 3. Thus, each combination of the slot 130, the threaded nut 132 and the guidehole 134 is symmetrically located within the corresponding protuberance 118 spaced 120 degrees from any adjacent protuberance 118.

A threaded shaft 138 is shown in alignment with the guidehole 134 and the threaded hole 136 of the nut 132 of each protuberance 118 in an aluminum embodiment as shown in FIG. 3. The threaded shaft 138 can be of the variety having a hex-shaped bolt head 140 with a suitable indentation formed on the surface of the bolt head 140 for receiving a Phillips Head screwdriver (not shown). Each of the threaded shafts 138 also includes a piercing head 142 for penetrating the housing 124 of the seized engine oil filter 102. The guidehole 134 has a bore diameter slightly larger than the diameter of the threaded shaft 138. The larger diameter guidehole 134 enables the piercing head 142 of each respective threaded shaft 138 to pass through the guidehole 134 and into the threaded nut 132 as shown in the cross-sectional view of FIG. 4.

The combination of the threaded shaft 138 and the threaded nut 132 is referred to as a threaded shaft and nut assembly 144. The larger diameter bore of the guidehole 134 also provides physical support for the three threaded shaft and nut assemblies 144. It is emphasized that the threads of the shaft 138 do not thread into the guidehole 134 but merely passes therethrough. The threads of the shaft 138 only mate with the threaded nut 132. Once the threads of the shaft 138 are mated with the threads of the nut 132, the nut is retained in the slot 130. By referring to FIGS. 4 and 5, respectively, it can be seen that the nut 132 remains supported within the slot 130 whether the threaded shaft 138 is in the retracted or extended condition. This is the case since the threads of the shaft 138 are always mated with the threads of the nut 132 in both the retracted and extended condition of the shaft 138 shown respectively in FIGS. 4 and 5.

The entire wrench 100, with the exception of the threaded shaft and nut assemblies 144, is cast in a single mold (not shown) as a single unit and is formed preferably of aluminum or, in the alternative, steel. Such a molding process is known in the art. The threaded shafts 138 and the corresponding threaded nuts 132 of the threaded shaft and nut assemblies 144 are the only components formed of steel in the preferred aluminum embodiment. It is noted that the hard steel threaded shafts 138 are not threaded into any of the softer aluminum components. Additionally, in the alternate steel construction, the protuberance 118 and the slot 130 formed therewith could be replaced by tack welding the steel nut 132 directly to the exterior surface 116 of the wall 108 in alignment with the guidehole 134. The threads of the shaft 138 would then mate with the threads of the nut 132 on the exterior surface 116 of the wall 108.

The present invention is useful in installing and removing the engine oil filter 102 from an oil filter mount (not shown) on the engine block. Under normal conditions, the oil filter 102 has not been over-torqued when initially installed, e.g., the manufacturer's installation instructions were properly followed. The wrench 100 can be employed to remove the oil filter 102 as follows. Each of the plurality of threaded shafts 138 is retracted as is shown in FIG. 1. The wrench 100 is then placed over the oil filter housing 124 so that the flat keyed edges 122 formed on the interior surface 120 of the wall 108 of the wrench 100 engage the corresponding edges or lugs 126 formed on the closed end 128 of the oil filter. Thereafter, the end of the extension shaft 114 of the ratchet driver 112 is fitted into the socket receptacle 110. A suitable amount of rotational torque is then applied in the appropriate direction to a handle 146 of the ratchet driver 112 to remove the oil filter 102 from the oil filter mount.

If the oil filter 102 can be removed as described in the preceding paragraph, then the task of removing the oil filter 102 is complete. However, if the oil filter 102 was over-torqued when initially installed and is now seized, removal can be accomplished by utilizing the additional novel features exhibited by the present invention. The wrench 100, with the threaded shafts 138 in the retracted position, is fitted over the oil filter housing 124 so that the flat keyed edges 122 of the wrench 100 engage the edges or lugs 126 of the filter housing 124 as described above. A cross-sectional view showing the threaded shaft 138 in the retracted position is illustrated in FIG. 4. The threaded shaft 138 is not pinching or penetrating the oil filter housing 124 and is not interrupting the integrity of the filtering material 148.

In order to avoid leakage of contaminated oil resident within the oil filter housing 124, it is suggested that a small hole be placed in the lowest portion of the oil filter housing 124. The oil can then be gravity drained into, for example, an oil catch basis. Such a hole can be placed in the oil filter housing 124 with a pin punch and hammer (not shown). After all the residual oil resident within the filter housing 124 has drained out, the three threaded shafts 138 are driven from the retracted position to the extended position.

This is accomplished by holding the cap-shaped housing 104 with one hand and advancing the threaded shafts 138 by rotation with an appropriate wrench, nut driver or Phillips Head screwdriver. Such action will cause the piercing head 142 of each of the threaded shafts 138 to penetrate the oil filter housing 124. A cross-sectional view showing the threaded shaft 138 in the extended position is illustrated in FIG. 5. If each of the three threaded shafts 138 is advanced to the extended position, then the wrench 100 is effectively locked to the filter housing 124 at three symmetrical locations. Each of these three locations are displaced by 120 degrees from one another. Consequently, force applied in the appropriate direction to the handle 146 of the ratchet driver 112 will be maximized and equally distributed across the wrench 100 and the oil filter housing 124.

By following the above-described procedure, the oil filter 102 can be efficiently removed. Thereafter, the threaded shafts 138 can be withdrawn to the retracted position by using an appropriate tool and the removed oil filter 102 can be discarded. A new filter 102 can then be applied in accordance with the manufacturer's instructions. The wrench 100 can also be employed to install the new filter 102. The oil seal (not shown) of the new oil filter 102 is lubricated with a thin film of oil. Then the cap-shaped housing 104 is placed over the closed end 128 of the oil filter housing 124 so that the corresponding edges mate as previously described. Thereafter, the extension shaft 114 is inserted into the socket receptacle 110 and suitable rotational torque is applied to the wrench 100 and the new oil filter 102 via the handle 146 of the ratchet driver 112.

An alternative embodiment of the present invention is shown in FIG. 6 which illustrates a wrench 200 for use with a seized engine oil filter. Although not shown in FIG. 6, the engine oil filter with which the wrench 200 is utilized is exactly the same as the oil filter 102 shown in FIG. 1 of the preferred embodiment. Thus, with respect to the wrench 200, reference will be made to the oil filter 102 and the various oil filter components as shown in FIG. 1.

The wrench 200 includes a handle 204 and a flexible metal band 206. The handle 204 is comprised of a narrow strip of steel or aluminum that is bent or formed into the shape of an open-ended rectangle reminiscent of a pair of tongs. A bottom or closed end 208 of the rectangular handle 204 serves as that portion of the handle 204 that is operated to rotate the oil filter 102 shown in FIG. 1. The two sides of the handle 204 which form an open end 210 are held in stationary position by a pair of rivets or pins 212 and 214, respectively, as shown in FIG. 6.

The flexible metal band 206 shown in FIG. 6 is comprised of flexible steel and is manipulated into the shape of a loop suitable for encircling the oil filter housing 124 shown in FIG. 1. The steel band 206 has a first end 216 and a second end 218. The first end 216 of the steel band 206 is wrapped about rivet or pin 212 while the second end 218 of the steel band 206 is wrapped about rivet or pin 214. In order to further secure the two ends 216 and 218 to the rivets or pins 212 and 214, respectively, each of the ends 216 and 218 can be tack welded in the following manner. The end 218 is clearly seen as being wrapped underneath and back over the top of rivet or pin 214. The terminal portion of end 218 can then be further secured to the steel band 206 by tack welding them together at, for example, a point 220 as is known in the art. This description is also representative of securing the end 216 about rivet or pin 212 and then tack welded to the flexible steel band 206.

FIG. 6 is intended to be representative of the alternative embodiment. It is noted that the end 218 of steel band 206 is clearly visible as being wrapped about rivet or pin 214 and then secured to steel band 206. Although the end 216 of steel band 206 is not as visible in FIG. 6 as the end 218, it is to be understood that the end 216 of steel band 206 is wrapped about rivet or pin 212 and secured to steel band 206 in the exact same manner in the representative embodiment.

Furthermore, it is to be understood that the ends 216 and 218 are merely wrapped about rivets or pins 212 and 214, respectively. Additionally, rivets or pins 212 and 214 are stationary. Therefore, wrapped ends 216 and 218 are free to rotate about the stationary rivets or pins 212 and 214, respectively. Thus, rivets or pins 212 and 214 serve as pivot points for the ends 216 and 218. Notwithstanding the method employed to connect the ends 216 and 218 of steel band 206 to the respective rivets or pins 212 and 214, it is to be understood that the ends 216 and 218 rotate about the rivets or pins 212 and 214 when the wrench handle 204 is rotated.

The wrench 200 illustrated in FIG. 6 shows the handle 204 depicted in the tensioned or gripping position. As shown, the handle 204 is positioned to the far right side of the wrench 200 e.g., force is applied to the handle 204 in the downward direction. By placing the handle 204 in this position, the end 218 of steel band 206 is pulled with the handle 204 and forced over the end 216 as shown in FIG. 6. This action causes the diameter of the steel band 206 to become smaller and thus to be tensioned or gripped about the oil filter 102 (shown in FIG. 1) when the band 206 is placed around the filter housing 124 (shown in FIG. 1). As depicted in FIG. 6, further movement of the handle 204 in the downward direction applies sufficient gripping force to remove the oil filter 102 (shown in FIG. 1) when it has not been overtorqued or seized.

Likewise, if the handle 204 is moved in the upward direction, e.g., so that the handle 204 appeared to move to the left side of FIG. 6., the end 218 of steel band 206 would be pulled with the handle 204 and forced away from the end 216 as shown in FIG. 6. This action would cause the diameter of the steel band 206 to become larger and thus to be less tensioned or to be loose about the oil filter 102 (shown in FIG. 1). In this position, further movement of the handle 204 in the upward direction as depicted in FIG. 6 would enable the steel band 206 to be removed from the oil filter 102 (as shown in FIG. 1).

When the oil filter 102 (shown in FIG. 1) has been overtorqued and is now seized, it cannot be efficiently removed with conventional oil wrenches because the steel band will slip about the filter housing 124 when additional gripping force is applied. The additional novel features of the wrench 200 which solve this problem will now be described.

As shown in FIG. 6, the steel band 206 is penetrated to provide circular openings 222 and 224. Openings 222 and 224 are approximately diametrically opposed on the steel band 206. Thereafter, a threaded nut 226 is positioned over each hole 222 and 224 so that a hole 228 formed in each nut 226 is aligned with the circular openings 222 and 224, respectively. The threaded nuts 226 can be selected to be steel hex-shaped or square threaded nuts. The steel threaded nuts 226 are then tack welded to the flexible steel band 206 so that the hole 228 in each threaded nut 226 is aligned with the holes 222 and 224, respectively, in the steel band 206.

A pair of threaded shafts 230 are then mated with the threaded nuts 226 which are tack welded to the steel band 206. The threaded shafts 230 can be of the variety having a hex-shaped bolt head 232 with a suitable indentation formed on the surface of the bolt head 232 for receiving a Phillips Head screwdriver (not shown). Each of the threaded shafts 230 also include a piercing head 234 for penetrating the oil filter housing 124 (shown in FIG. 1). When engaged, the threaded shafts 230 are held in position by the threaded nuts 226.

The following procedure should be followed in removing a seized engine oil filter 102 (shown in FIG. 1) with the wrench 200 of the alternative embodiment. As in the preferred embodiment, the oil resident within the seized oil filter 102 should be removed prior to utilizing the wrench 200. It is suggested that a small hole be placed in the lowest portion of the oil filter housing 124 (shown in FIG. 1). The oil can then be gravity drained into, for example, an oil catch basis. Such a hole can be placed in the oil filter housing 124 with a pin punch and hammer (not shown).

After all the residual oil resident within the filter housing 124 has drained out, the flexible steel band 206 is positioned around the filter housing 124. The wrench handle 204 is then operated in the appropriate direction to tighten the grip of the steel band 206 about the filter housing 124. At this point, the threaded shafts 230 are in the retracted position. While holding the wrench handle 204 in the gripping position, the threaded shafts 230 are rotated clockwise with an appropriate tool to force the piercing heads 234 into the filter housing 124.

An appropriate tool to rotate the threaded shafts 230 at the bolt heads 232 can include a ratchet driver, a nut driver or screwdriver (not shown). Once the piercing heads 234 are embedded in the oil filter housing 124 (shown in FIG. 1), additional force can be applied to the wrench handle 204 to rotate the oil filter 102 (shown in FIG. 1). Because the two threaded shafts 230 are placed in a symmetrical pattern, the force applied to the wrench handle 204 is equally distributed to the flexible steel band 206 and to the oil filter housing 124. Thus, the wrench 200 is positively locked to the oil filter housing 124 resulting in the efficient removal of the oil filter 102. It should be noted that additional threaded shafts 230 can be installed in the steel band 206 if desired.

Once the oil filter 102 (shown in FIG. 1) is removed, the threaded shafts 230 can be backed out of the filter housing 124 by rotating the shafts 230 counterclockwise out of the threaded nuts 226. The oil filter 102 can then be discarded and a new oil filter 102 can be installed in accordance with the manufacturer's installation instructions. After the appropriate oil film is applied to the oil seal, the wrench 200 can be employed to install the new oil filter 102. This is accomplished by placing the steel band 206 around the new filter housing 124 after the oil filter has been mounted. The threaded shafts 230 remain in the retracted position and the wrench handle 204 is operated in the appropriate direction to tighten the oil filter 102 to the oil filter mount on the engine with the appropriate torque.

The present invention provides novel advantages over other oil filter wrenches known in the art. Each of the wrench embodiments 100 and 200 of the present invention featuring the cap-shaped housing 104 and the flexible steel band 206 provides numerous advantages. One of the main problems present in the prior art has been solved, e.g., both the cap-shaped housing 104 and the flexible steel band 206 is effectively locked to the oil filter housing 124. Thus, slippage of the wrench around the oil filter 102 no longer occurs. In addition, since each of the wrench embodiments 100 and 200 is positively locked to the oil filter housing 124, the torque applied to the cap-shaped housing 104 via the ratchet driver 112 and the torque applied to the flexible steel band 206 via the wrench handle 204 is maximized. Thus, a seized oil filter 102 is much easier to remove.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A wrench for use with a seized engine oil filter comprising:

a cap-shaped housing including a planar top surface and a wall formed orthogonal to the perimeter of said top surface;

means formed on an inner surface of said wall for engaging a housing of said oil filter;

means mounted to said wall including a plurality of piercing shafts for piercing said oil filter housing to lock said cap-shaped housing to said oil filter for maximizing the torque on said oil filter when said cap-shaped housing is rotated each of said piercing shafts threadedly secured to one of a corresponding plurality of threaded nuts each housed within one of a corresponding plurality of slots formed in said wall; and means for rotating said cap-shaped housing.

2. The wrench of claim 1 wherein said cap-shaped housing is comprised of aluminum.

3. The wrench of claim 1 wherein said cap-shaped housing is comprised of steel.

4. The wrench of claim 1 wherein said means formed on said inner surface of said wall include a plurality of keyed edges positioned congruent with a corresponding set of edges formed on said oil filter housing.

5. The wrench of claim 1 wherein said means for rotating said cap-shaped housing includes a receptacle formed within said planar top surface for receiving a tool.

6. The wrench of claim 5 wherein said receptacle comprises a socket for receiving a ratchet driver tool.

7. The wrench of claim 1 wherein each of said slots is formed within one of a corresponding set of protuberances extending externally from said wall.

8. A wrench for applying maximum torque to a seized engine oil filter comprising:

a cap-shaped housing having a top surface and a wall;

means formed on an inner surface of said wall for engaging said oil filter;

a plurality of threaded shaft and nut assemblies each located within one of a corresponding plurality of protuberances having a slot formed therein and symmetrically positioned within said wall, said threaded shaft and nut assemblies for piercing said oil filter and locking said cap-shaped housing to said oil filter; and means for rotating said cap-shaped housing.

* * * * *